United States Patent [19]

Schorr

[11] 3,961,553

[45] June 8, 1976

[54] TWO-TIER CHROMATIC THUMB PIANO

[76] Inventor: Steven M. Schorr, 2853 Webb Ave., Bronx, N.Y. 10468

[22] Filed: July 14, 1975

[21] Appl. No.: 595,377

[52] U.S. Cl. ..... 84/408
[51] Int. Cl.[2] ..... G10D 13/08
[58] Field of Search ..... 89/402, 408

[56] References Cited

UNITED STATES PATENTS

| | | | |
|---|---|---|---|
| 1,763,518 | 6/1930 | Haweis | 84/408 |
| 2,645,970 | 7/1953 | Stabile | 84/403 |
| 3,610,085 | 10/1971 | Wilson et al. | 84/402 |

FOREIGN PATENTS OR APPLICATIONS

| | | | |
|---|---|---|---|
| 135,810 | 12/1919 | United Kingdom | 84/408 |
| 287,802 | 3/1928 | United Kingdom | 84/408 |
| 804,131 | 11/1958 | United Kingdom | 84/402 |
| 900,796 | 2/1962 | United Kingdom | 84/402 |

*Primary Examiner*—Lawrence R. Franklin

[57] ABSTRACT

In a preferred embodiment, there is provided a two tier chromatic thumb piano of separate sets of elongated finger members for each set ranging in lengths to produce a tonal scale of even increments, with one set's tones being adapted to fall equally intermediate of tones of finger members of the other set, the finger members of both sets from their respective tier supports extending in a common direction for adjacent finger members and for adjacent sets along an elongated upper surface of substantially hollow sounding vessel structure having an enclosed space defined therein with an opening in the upper face as an enlarged hole, and with spaced-apart small-hole apertures in the underside face of the vessel structure, the finger members of the upper and lower tiers being commonly braced into fixed and anchored positions and states by a single unitary clamping element screwed onto an upper face of the vessel structure and having a series of adjacent slit apertures therein clampably receivable of the respective finger members, one finger member per slit for the higher tier set and one finger member from the lower set — two slits per finger member with the slits aligned one behind the other along the elongated axis of the respective finger member, such that the unitary clamping element clamps each finger member between two spaced-apart fulcrum points, thereby securing the finger member.

7 Claims, 3 Drawing Figures

TWO-TIER CHROMATIC THUMB PIANO

This invention relates to a novel chromatic thumb piano for obtaining new and easily obtainable musical effects.

BACKGROUND TO THE INVENTION

Prior to the present invention, there have existed thumb pianos of the general type to which the present invention is directed, but with limited possibilities of varying tonal variations and without any apparent means of increasing such possibilities in any manner by which a player might reasonably maneuver easily.

SUMMARY OF THE INVENTION

Accordingly, objects of the present invention include the overcoming of one or more difficulties and limitations and shortcomings of the types described above, together with novel advantages and effects.

Another object is to obtain a novel chromatic thumb piano structure of multiple tiers having stepped sets of finger members readily available for and accessible for easy playing and for the shifting to and fro from one set to the other.

Another object is to obtain a novel construction for the multiple tiered chromatic thumb piano making possible easy adjustment and/or mounting of the respective finger members of the finger member sets.

Another object is to place underside sounding-box apertures at locations readily sealable by available free fingers of the person holding the piano structure, and making possible novel variations in sound and tonal effects.

Other objects become apparent from the preceding and following disclosure.

One or more objects of the present invention are obtained by the invention as defined herein.

Broadly the invention may be defined as a sounding vessel having upper and lower faces and enclosing a sounding space that communicates with exterior space through a conventional upper enlarged hole through-space, and having a second upper tier set of finger members over-hanging a prior conventional lower tier of set of finger members, the tiers being stepped in arrangment at one end of the elongated sounding vessel such that the lower distal ends of the lower tier set of finger members extend from beneath the commonly-direction extending upper tier finger members distal ends; the lengths of the finger members, as with conventional thumb pianos, vary in lengths differing in lengths by predetermined equal increments of tone, and the lengths of one tier set differing from lengths of the other with lengths adapted such that tones of one tier are substantially half-way intermediate of tones of the corresponding finger members in series of the other tier set. Additionally, a particularly advantageous and novel clamping element is a unitary structure for simultaneously anchoring and clamping into place finger members of both sets, preferably being a strip of material having a row or series of holes or aperture short slits in one end thereof and having a separate series of elongated slits in an opposite end of the strip, bent into or formed in a substatially U-shape or V-shape or the like resulting in commonly-direction extending legs with finger members of the lower tier extending through slits at both ends of the clamping element, i.e. through two slits per leg for each lower tier finger member, and with the upper tier set's finger members each extending through only one leg's slit, whereby each finger member is anchored and pressed against and between two spaced-apart fulcrum structures mounted on the sounding vessel. The clamping element preferably is anchored by one or more anchoring screws onto the sounding vessel at point(s) intermediate between the legs.

The underside of the sounding box or vessel has finer holes typically one or two in number which may be sealed for obtaining varying sound and tonal effects, particularly by tapping the holes immediately following a striking of a finger member to obtain a musical tone.

Preferably, one tier is capable of producing fractional tones in variation from those of the other tier's set of finger members, such as half-tone variations, in effect achieving an oriental flavor of music, or the like.

The invention may be better understood by making reference to the Figures as follow, for a preferred embodiment.

THE FIGURES

In like manner, views of 3′ and 3″ represent views along the lines 3′—3′ and 3″—3″ respectively, in cross-sections through different portions of the sounding vessel and finger member sets.

DETAILED DESCRIPTION OF THE INVENTION

Figure 1:
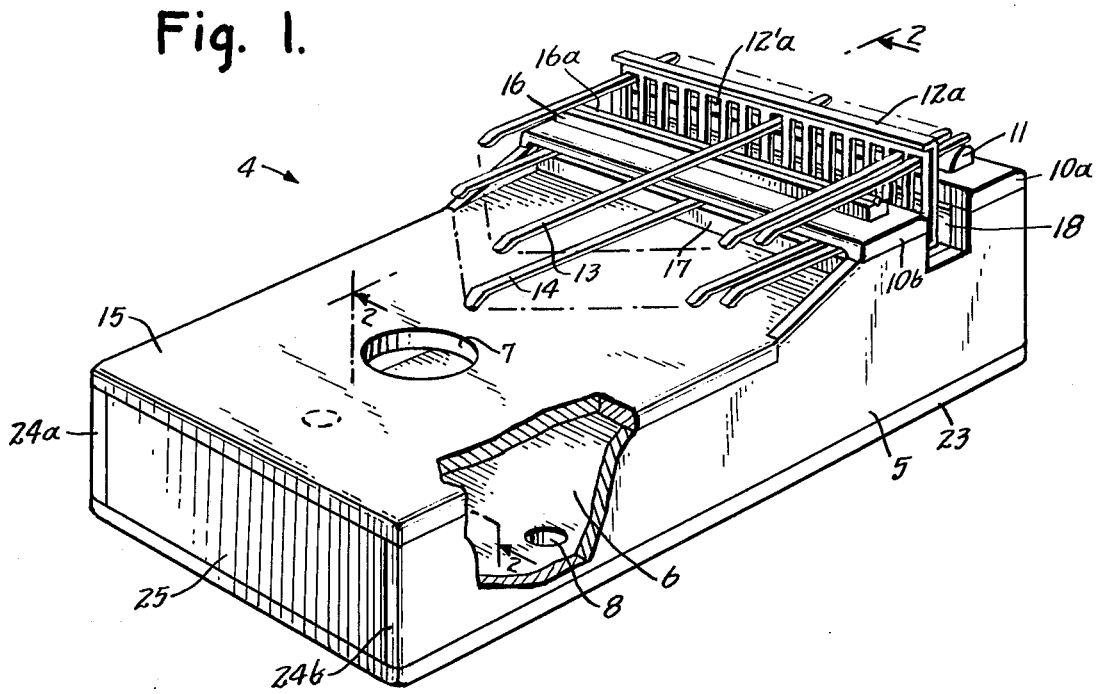
FIG. 1 illustrates a perspective front side view of a preferred embodiment of the novel two tier chromatic thumb piano of the present invention.
Figure 2:
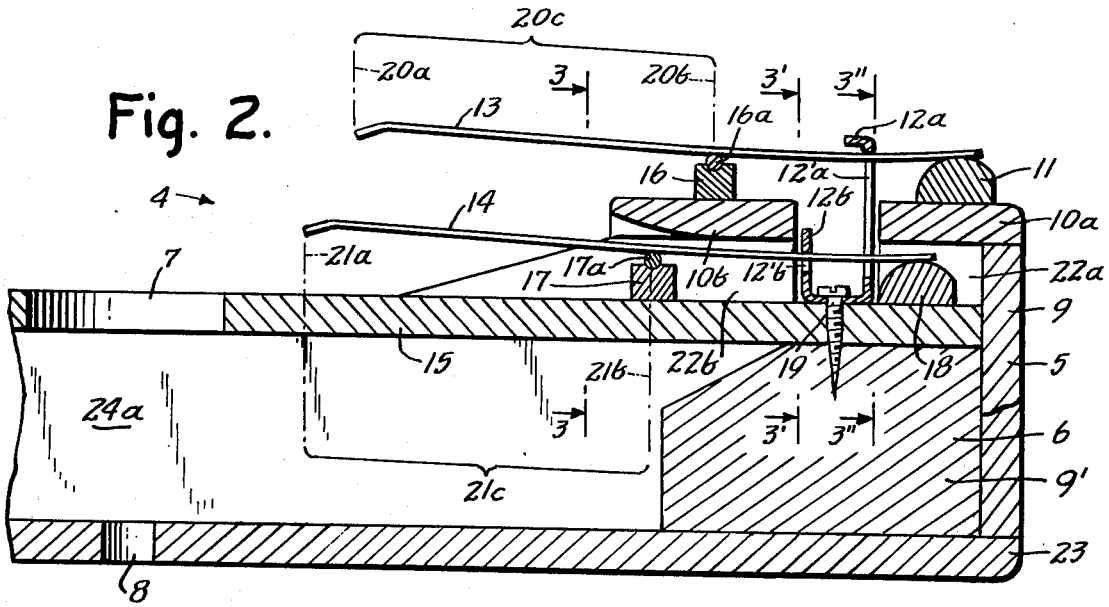
FIG. 2 illustrates an in-part view in cross-section as taken along lines 2—2—2 of FIG. 1, one line of view being horizontally extending and the other line of view being vertical through upper and lower holes respectively.
Figure 3:
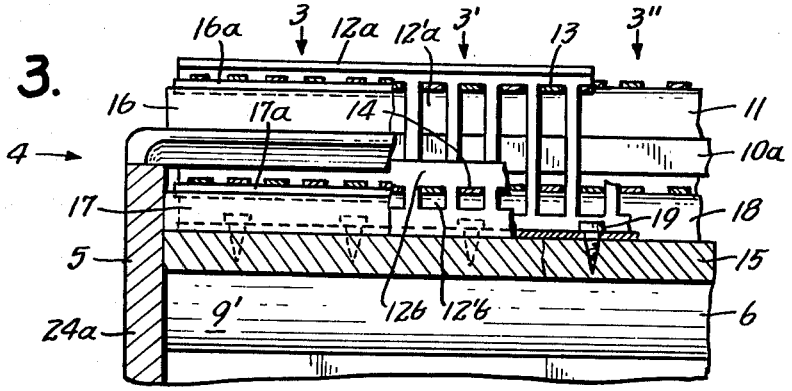
FIG. 3 illustrates another in-part view along a line extending transversely across the sounding vessel and finger member sets along lines 3—3 of FIG. 2.

In greater detail, FIGS. 1 through 3 represent a common preferred embodiment of the present invention in varying view thereof for better understanding in its illustration, disclosing a two-tiered chromatic thumb piano 4.

The piano 4 includes a sounding vessel 5 having opposite upright sides **24*a* and 24*b*, and opposite end upright walls 9 and 25, and upper face horizontal wall 15 and lower face horizontal wall 23, these four side walls and upper and lower walls defining enclosed space 6. The upper wall 15 has sounding vessel hole 7 by which the space 6 communicates with exterior space, and the lower wall 23 has spaced-apart finger apertures 8 also by which the space 6 communicates with the exterior space. Wall strip structures 10*a* and 10*b* provide for support of the upper tier (higher tier) set of finger members 13, while the upper wall 15 provides for support of the lower tier set of finger members 14. Spaced-apart fulcrums 11 and 16*a* have resting thereupon the lower faces of the plurality of finger members of upper tier set 13, and spaced-apart fulcrums 18 and 17*a*, member 16′ being carried by strip element 16, and member 17*a* being carried by strip element 17, as best viewed in FIG. 2. Secure anchoring and positioning of the respective finger members of the sets 13 and 14 respectively are achieved in this preferred embodiment by the unitary clamping element having legs 12*a* and 12*b* substantially vertically extending, leg 12*a* having a series of slits 12′*a* arranged in a horizontally-extending line of locations with one set 13** finger member and one set 14 finger member extending through each slit, with the structure of the upper end of the slit pressing downwardly upon an upper surface of the respective finger members of set 13 at a point intermediate between the upwardly-pressing fulcrums 11 and 16. In like manner, the set 14 finger members extend through the slits 12'*b*, one finger member per slit, with the upper structure of the slit 12'*b* pressing downwardly onto an upper face of the finger member (of set 14) extending therethrough at a point intermediate between the fulcrums 18 and 17*a* which press upwardly on the lower face of the same respective finger member (of set 14). The threaded (male-threaded) screw 19 extends through an anchor hole in an intermediate portion of the clamping element between legs 12*a* and 12*b*, anchoring the sets 13 and 14 to the sounding vessel 5, within the intermediate space between the strips 10*a* and 10 *b*. Screw 19 anchors wood block 9'.

For the upper or higher tier set 13 of finger members, the distance 20*c* as measured between points 20*a* and 20*b* for a particular finger member as compared to distance 21*c* as measured between points 21*a* and 21*b*, for a corresponding finger member of set 14, is of a different length differing by a predetermined length as previously noted preferably such as to produce a tone which is a half-step from that corresponding one of the other set, and a whole tone from an adjacent finger member of the same set. The upward projection of side 24*b* at the point of supporting the strip 10*b* is identified in FIG. 2 as wall 22*b*, and in like manner the upward projection 22*a* supports the strip 10*a*.

It is within the scope of the present invention to make variations and substitution of equivalents as would be apparent to a person of ordinary skill.

I claim:

1. A multi-tier chromatic thumb piano comprising in combination: an elongated enclosure vessel means defining an elongated space within, and defining at one end thereof an upper-face stepped support structure including a higher tier in juxtaposition to said one end and a lower tier adjacent thereto located toward a remaining spaced-away other end thereof, and defining a through-aperture within an upper face of the vessel means such that said elongated space is in communication with exterior space; two sets of elongated semi-flexible finger members of varying lengths from one-another ranging from predetermined short length to predetermined long length in steps of length predetermined to equal tone variations, one set having lengths of the finger members adapted as to obtain tones of substantially half-way intermediate tones relative to a second sets finger members, the one set being mounted to extend substantially horizontally above an upper face of the elongated enclosure vessel means from the higher tier, and the second set being mounted to extend substantially horizontally above the upper face from the lower tier, distal ends of finger members of the one set and of the second set respectively extending substantially toward said remaining spaced-away other end.

2. A multi-tier chromatic thumb piano of claim 1, in which each of the higher and lower tiers include spaced-apart forward and rearward fulcrum structures contacting a common lineally extending face of a finger member for each finger member for the set of the respective tier, and in which each of the higher and lower tiers includes an intermediate fulcrum structure contacting an opposite face of the respective finger member opposite from said common lineally extending face, adapted such that each finger member of each set is securely clamped in a fixed position and state, said distal ends of said second set extending from beneath the distal ends of the one set.

3. A multi-tier chromatic thumb piano of claim 2, in which said intermediate fulcrum structure for the higher tier is a substantially common and unitary structure with the intermediate fulcrum structure for the lower tier connected by inter-connecting anchoring structure detachably mounted on a separate base portion of said elongated enclosure vessel means, and for its respective tier each intermediate fulcrum structure being a strip positioned uprightly, the lower tier having a plurality of through-apertures in side-by-side arrangement for receiving respective finger members of the second set while exerting fulcrum pressure onto said opposite face of the respective finger members of the second set, and the higher tier having a plurality of through-apertures in side-by-side arrangement for receiving respective finger members of each of the one set and the second set while exerting fulcrum pressure onto said opposite face of the respective finger members of said one set, said inter-connecting anchoring structure including anchoring means for the anchoring thereof to said separate base portion.

4. A multi-tier chromatic thumb piano of claim 3, in which at least one through-aperture is defined through a lower face of the elongated enclosure vessel means such that said elongated space is in communication with exterior space therethrough.

5. A multi-tier chromatic thumb piano of claim 4, including at least a second through-aperture defined through said lower face of the elongated enclosure vessel means such that said elongated space is in communication with exterior space therethrough.

6. A multi-tier chromatic thumb piano of claim 1, in which at least one through-aperture is defined through a lower face of the elongated enclosure vessel means such that said elongated space is in communication with exterior space therethrough.

7. A multi-tier chromatic thumb piano of claim 6, in which at least one through-aperture is defined through a lower face of the elongated enclosure vessel means such that said elongated space is in communication with exterior space therethrough.

* * * * *